US006338563B1

(12) United States Patent
Norman

(10) Patent No.: US 6,338,563 B1
(45) Date of Patent: Jan. 15, 2002

(54) LIGHTED SIGN DISPLAY ASSEMBLY

(76) Inventor: Jeff Norman, 9016 - 48$^{TH}$ Pl. West, Mukilteo, WA (US) 98275

( * ) Notice: Subject to any disclaimer, the term of this patent is extended or adjusted under 35 U.S.C. 154(b) by 0 days.

(21) Appl. No.: 09/497,847

(22) Filed: Feb. 3, 2000

Related U.S. Application Data

(60) Provisional application No. 60/118,835, filed on Feb. 5, 1999.

(51) Int. Cl.$^{7}$ ..... F21V 29/00

(52) U.S. Cl. ..... 362/268; 362/311; 362/397; 362/812

(58) Field of Search ..... 362/268, 373, 362/812, 345, 397, 310, 311

(56) References Cited

U.S. PATENT DOCUMENTS

| | | | | | |
|---|---|---|---|---|---|
| 4,101,957 | A | * | 7/1978 | Chang | 362/268 |
| 5,315,495 | A | * | 5/1994 | Buser | 362/373 |
| 6,060,838 | A | * | 5/2000 | Cantoni et al. | 315/159 |
| 6,154,994 | A | * | 12/2000 | O'Brien et al. | 40/575 |

* cited by examiner

*Primary Examiner*—Sandra O'Shea
*Assistant Examiner*—John Anthony Ward
(74) *Attorney, Agent, or Firm*—Graybeal Jackson Haley LLP

(57) ABSTRACT

A lighted sign display assembly includes a housing a lens aperture formed at a base end of the housing. The lens aperture secures a lens to the housing within the lens aperture, and the lens has areas that are formed to convey visual information. A lens removal aperture is formed near the base end of the housing to receive an object that applies a force to the lens to remove the lens from the aperture. At least one mounting projection is formed near the base end of the housing, each mounting projection receiving a mounting device to secure the display assembly to a desired object. An illumination assembly is secured in an aperture formed at an end of the housing opposite the lens aperture. The housing includes a temperature aperture formed to provide ventilation to dissipate heat generated by the illumination assembly. A reflective coating covers the interior surface of the housing, with the reflective coating reflecting light generated by the illumination assembly towards the lens. The housing may be ellipsoid-shaped, and the illumination assembly may include a power adapter coupled to the running lights or cigarette lighter of a vehicle to thereby apply electrical energy to the illumination assembly.

21 Claims, 6 Drawing Sheets

LIGHTED SIGN DISPLAY ASSEMBLY

This application claims benefit of provisional application Ser. No. 60/118,835 filed Feb. 5, 1999.

TECHNICAL FIELD

The present invention relates generally to electronic signs, and more specifically to a portable electronic sign for use in vehicles.

BACKGROUND OF THE INVENTION

Electronic signs are ubiquitous in society today and are utilized to convey countless types of visual information. For example, electronic signs are placed in store windows to indicate whether a store is open or closed or to advertise a particular product. Many such signs utilize neon bulbs formed in the shape of the desired message, such as a product name, and require AC power for illumination. The requirement for AC power makes the use of such signs difficult in situations where only DC power is available, such as in vehicles like cars and trucks. In addition, such signs may not be used in applications where the message being displayed needs to be changed. Another type of electronic sign is known as a backlit sign. In a backlit sign, a face plate or lens is formed having the desired message to be displayed, and a lens is placed in a housing having a light bulb which then illuminates the lens to thereby display the desired message. Such a backlit sign may be powered using either AC or DC power. While DC power may be utilized, in many instances the resulting illumination intensity is inadequate to display the desired message. In many situations, a backlit sign is utilized where it is desirable to be able to conveniently change the message displayed. For example, the sign may display prices that need to be periodically updated. In such applications, the lens must be capable of being easily removed from a housing so that the displayed message may be conveniently changed.

There is the need for a portable backlit electronic sign that provides relatively high intensity illumination and is also capable of displaying a variety of messages with relative ease.

SUMMARY OF THE INVENTION

According to one aspect of the present invention, a lighted sign display assembly includes a housing having an interior surface and an exterior surface. The housing includes a lens aperture formed at a base end of the housing. The lens aperture is adapted to secure a lens to the housing within the lens aperture, and the lens has areas that are formed to convey visual information. A lens removal aperture is formed near the base end of the housing. The lens removal aperture is adapted to receive an object that applies a force to the lens to thereby assist in removing the lens from the aperture. At least one mounting projection is formed near the base end of the housing. The mounting projection is adapted to receive a mounting device to secure the display assembly to a desired object. An illumination aperture is formed at an end of the housing opposite the lens aperture, and is adapted to secure an illumination assembly to the housing within the illumination aperture.

The lighted sign display assembly further includes at least one temperature aperture, with each temperature aperture being formed to allow heat generated by the illumination assembly to be transferred from the interior surface side of the housing to the exterior surface side. A reflective coating covers at least some of the interior surface of the housing, with the reflective coating reflecting light generated by the illumination assembly towards the lens. An illumination assembly is secured in the illumination aperture, and receives electrical energy and generates optical energy from the electrical energy.

According to further aspects of the present invention, the housing is an ellipsoid-shaped housing and the illumination assembly includes a power adapter that is coupled to the running lights of a vehicle to thereby apply electrical energy to the illumination assembly. The power adapter may also be adapted to be plugged into a cigarette lighter of a vehicle to supply electrical power.

DETAILED DESCRIPTION OF THE INVENTION

Figure 1:
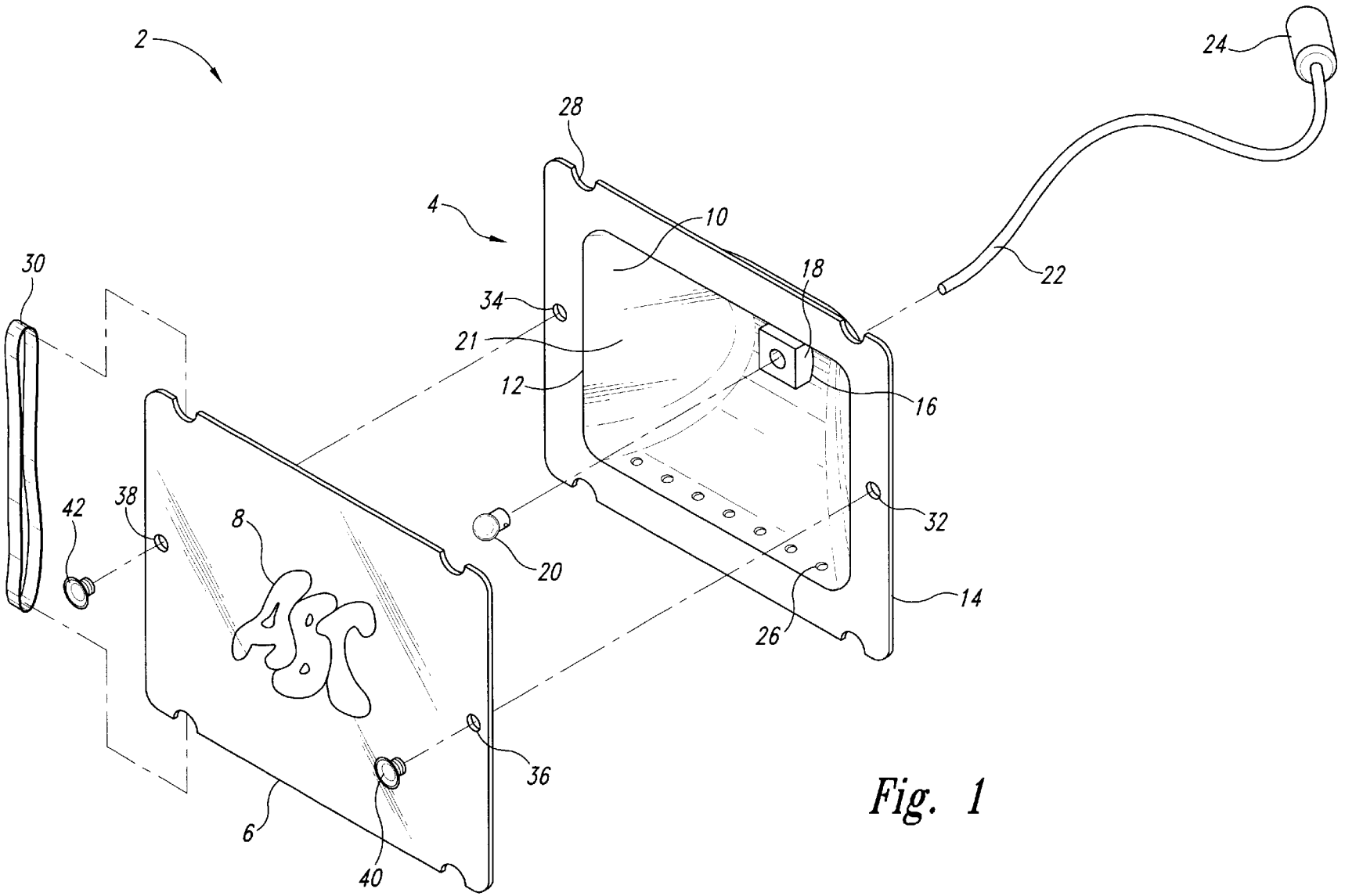
FIG. 1 is an exploded isometric view of a lighted sign display assembly according to one embodiment of the present invention.

FIG. 1 is an exploded isometric view of a lighted sign display 2 including a housing 4 and lens 6 according to one embodiment of the present invention. When the lighted sign display 2 is assembled, a desired message 8 on the lens 6 is illuminated to thereby display the message, as will be explained in more detail below. In the embodiment of FIG. 1, the housing 4 includes a rounded body 10 having a rectangular aperture 12 formed at a front end of the body and a front panel 14 integrally attached to the body 10 around the aperture 12. The body 10 and front panel 14 are typically formed from a high-heat plastic, but may also be formed from other suitable materials. The lens 6 is also typically formed from a suitable translucent plastic with the message 8 similarly being a translucent material either attached to the lens or silk screened onto the lens.

A mounting hole 16 is formed at a rear end of the rounded body 10, and a light fixture 18 is secured in the mounting hole. The light fixture 18 includes a socket in which a bulb 20 is placed, and further includes electric terminals (not shown) that supply electric power to the bulb 20. A power cable 22 has a first end connected to the electric terminals of the light fixture 18, and has a second end connected to a power adapter 24. The power adapter 24 receives power from an external source (not shown), and this power is applied through the cable 22 to illuminate the bulb 20 in the light fixture 18. A reflective coating 21 may be applied on the interior of the body 10 to reflect light generated by the bulb 20 toward the aperture 12. The power adapter 24 may be a cigarette lighter adapter for receiving power from a cigarette lighter socket in a vehicle, or a running lights adapter having clips that may be attached to the running lights of a vehicle to receive power, and may be any type of adapter suitable for connection to other the source of power being used to illuminate the bulb 20.

The body 10 further includes a plurality of ventilation holes 26 that allow circulation of air in the body 10 to remove heat generated by the bulb 20. The illustrated ventilation holes 26 are formed on the bottom of the body 10, but identical ventilation holes 26 (not shown) are formed on the top of the body 10. The ventilation holes 26 may also be formed on the sides of the rounded body 10 to provide for better air circulation, may only be formed on top, or may be omitted in some applications where the body 10 and lens 6 are large enough to sufficiently dissipate the heat generated by the bulb 20, as will be understood by those skilled in the art.

In the housing 4, the front panel 14 includes a plurality of notches 28, with each notch in the housing 4 having a corresponding notch in the lens 6. A rubber band 30 or other suitable device fits into the notches 28 to secure a lens 6 to the front panel 14 of the housing 4. The front panel 14 further includes two mounting holes 32 and 34, each of these mounting holes having a corresponding mounting hole 36 and 38, respectively, in the lens 6. Two suction cups 40 and 42 fit into the holes 32, 36 and 34, 38, respectively, and secure the sign display 2 to a display surface, such as a vehicle window. Other suitable components can be used in place of the suction cups 40, 42, such as screws or even adhesive on the front of the front panel 14.

Figure 2:
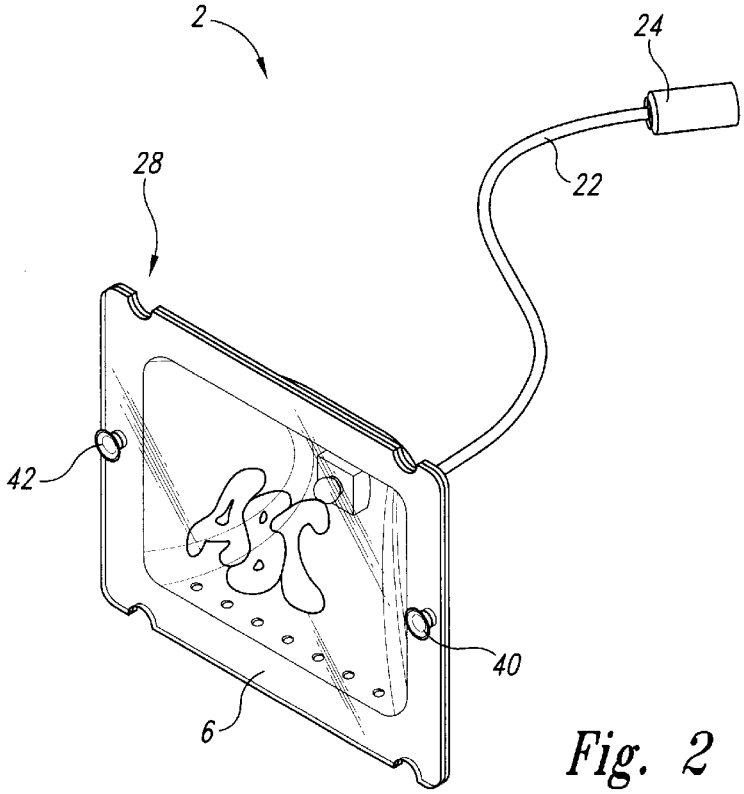
FIG. 2 is an isometric view of the assembled lighted sign display assembly of FIG. 1.

To assemble the lighted sign display 2, the power cable 22 is connected to the light fixture 18 and power adapter 24, and the light fixture 18 is thereafter placed in position in the mounting hole 16. The bulb 20 is then placed in the light fixture 18, and the lens 6 is secured in place against the front panel 14 by placing rubber bands 30 in the notches 28 formed on the lens 6 and front panel 14. Once the lens 6 has been secured in place against the front panel 14, the suction cups 40 and 42 are placed in holes 32, 36, and 34, 38, respectively. The precise order in which the components 4–42 are assembled to form the display 2 may vary, as will be understood by those skilled in the art. FIG. 2 is an isometric view of the assembled lighted sign display 2. In FIG. 2, the rubber bands 30 have been omitted merely for ease of illustration and, of course, would be secured in position in the notches 28. Once the display 2 has been assembled, it is placed in its desired display location by securing the suction cups 40, 42 to a suitable smooth surface, such as a vehicle window. The power adapter 24 is then connected to the appropriate power source, such as the vehicle running lights or cigarette lighter. When power is applied to power adapter 24, this power is applied through the cable 22 to the bulb 20 which, in turn, illuminates the lens 6 to thereby display the message 8.

Figure 3:
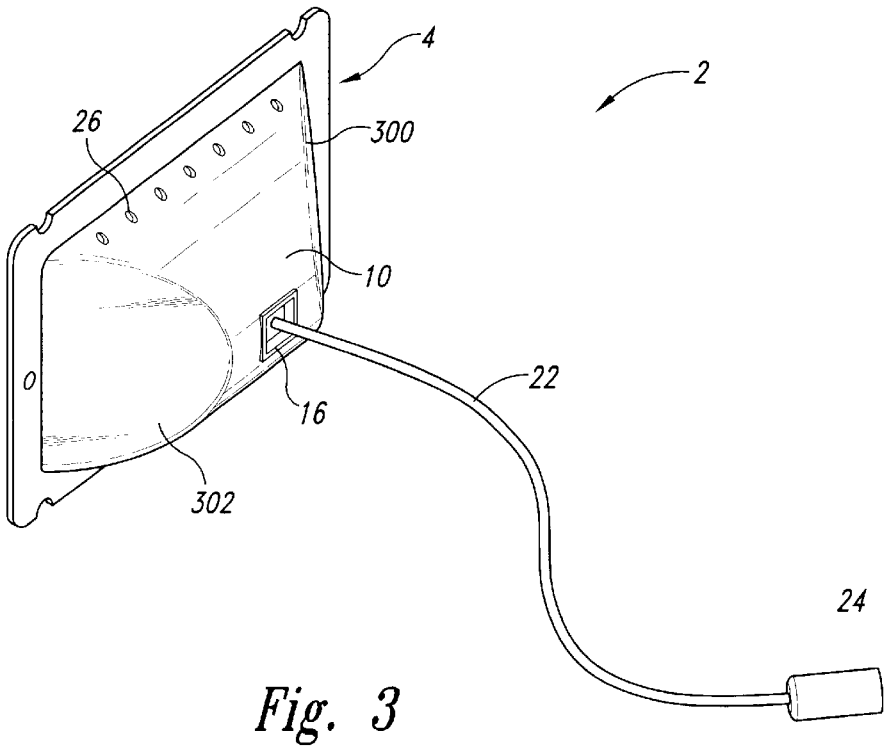
FIG. 3 is a rear isometric view of the display housing of FIGS. 1 and 2.
Figure 4:
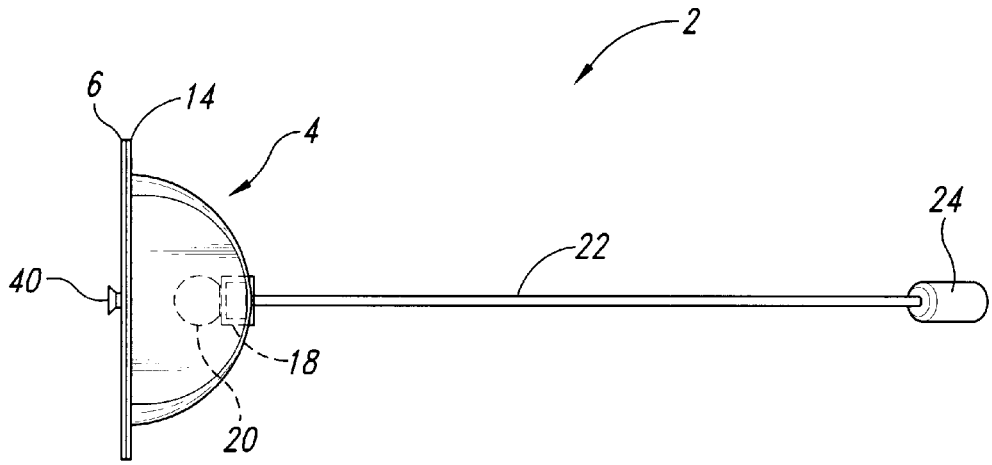
FIG. 4 is aside view of the assembled lighted sign display assembly of FIG. 2.
Figure 5:
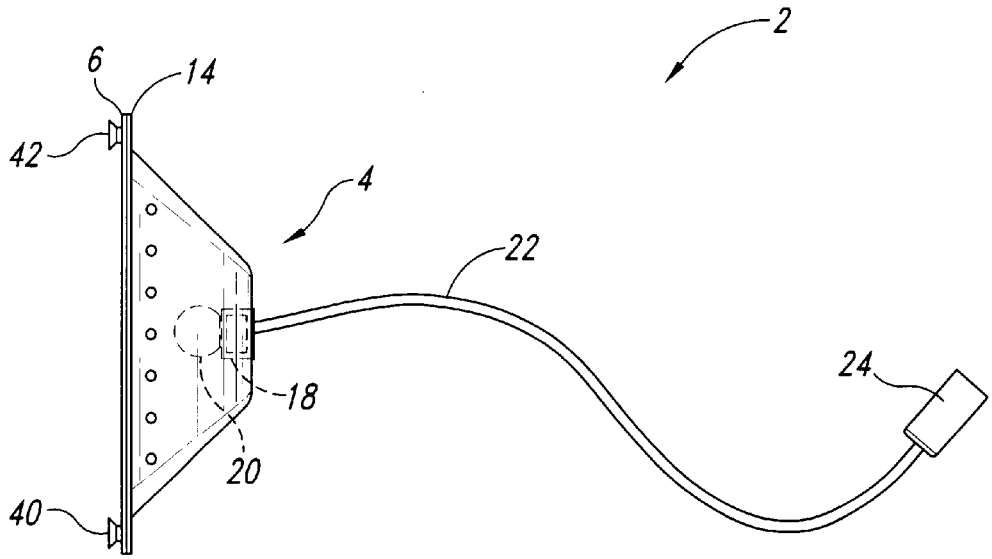
FIG. 5 is a top view of the assembled lighted sign display assembly of FIG. 2.

FIGS. 3–5 are various views of the lighted sign display 2 of FIGS. 1 and 2 that better illustrate the shape of the body 10. FIG. 3 is a rear isometric view of the display 2 illustrating the shape of the body 10. In the embodiment of FIG. 3, the body 10 includes first and second angled side walls 300, 302. The ventilation holes 26 are shown on top of the body 10. FIG. 4 is a side view and FIG. 5 is a top view of the display 2 further illustrating the shape of the housing 4.

Figure 6:
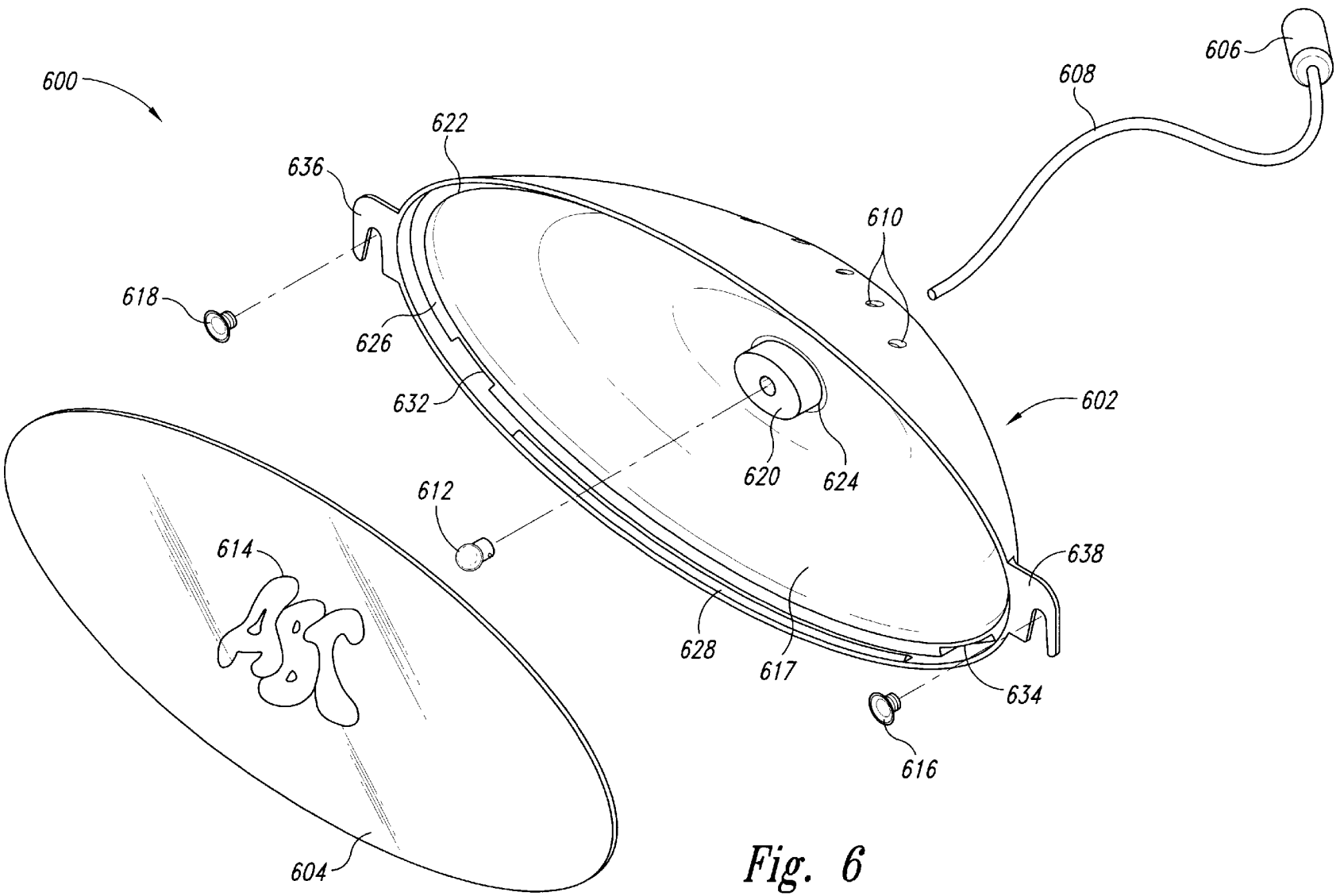
FIG. 6 is an exploded isometric view of a lighted sign display having an ellipsoid-shaped housing and lens according to another embodiment of the present invention.

FIG. 6 is an exploded isometric view of a lighted sign display 600 having an ellipsoid-shaped housing 602 and elliptical lens 604 according to another embodiment of the present invention. The display 600 includes components 606–620, each of which a corresponding component in the display 2 of FIG. 1 and thus, for the sake of brevity, these components will not again be described in detail. The housing 602 includes a lens aperture 622 formed at a front of the housing, and a illumination aperture 624 formed at a rear of the housing. An inner lens retaining projection 626 is formed around the perimeter of the aperture 622 at the front of the housing 600, along with two outer lens retaining projections 628 and 630 (see FIG. 7) formed along the bottom and top, respectively, of the elliptical front-end of the housing 602. The elliptical lens 604 is secured in place between the inner lens retaining projection 626 and outer lens retaining projections 628, 630, as will be described in more detail below. The housing 602 further includes two pry slots 632, 634 formed in the walls of the housing 602. The front of the pry slots 633, 634 are apertures in the surface of the inner lens retaining projection 626 as shown. The pry slots 632, 634 are formed to allow an object, such as a screwdriver, to be inserted into one or both of the slots to apply a force to the elliptical lens 604 to thereby remove the elliptical lens from between the inner retaining projection 626 and outer retaining projections 628, 630. Although two slots 632, 634 are shown in the embodiment of FIG. 6, the number may vary with there being one slot or no slots in alternative embodiments. Two mounting projections 636, 638 are formed at the front of the housing 602, each of the mounting projections 636 and 638 including a slot to receive the suction cups 618 and 616, respectively, to secure the housing 600 in place during operation, as previously described. A reflective coating 617 is applied to the interior surface of the housing 600 to reflect optical energy generated by the bulb 612 towards the front of the housing 602. Typically, the reflective coating 617 is applied after the aperture 624 and holes 610 have been formed, but may also alternatively applied before formation of these components, as will be appreciated by those skilled in the art. The housing 602 includes the ventilation holes 610 formed in the top of the housing, and may also include ventilation holes formed at other locations on the housing. The housing 602 may not need such ventilation holes 610 in some embodiments where the housing 602 and lens 604 can adequately dissipate the heat from the bulb 612.

Figure 7:
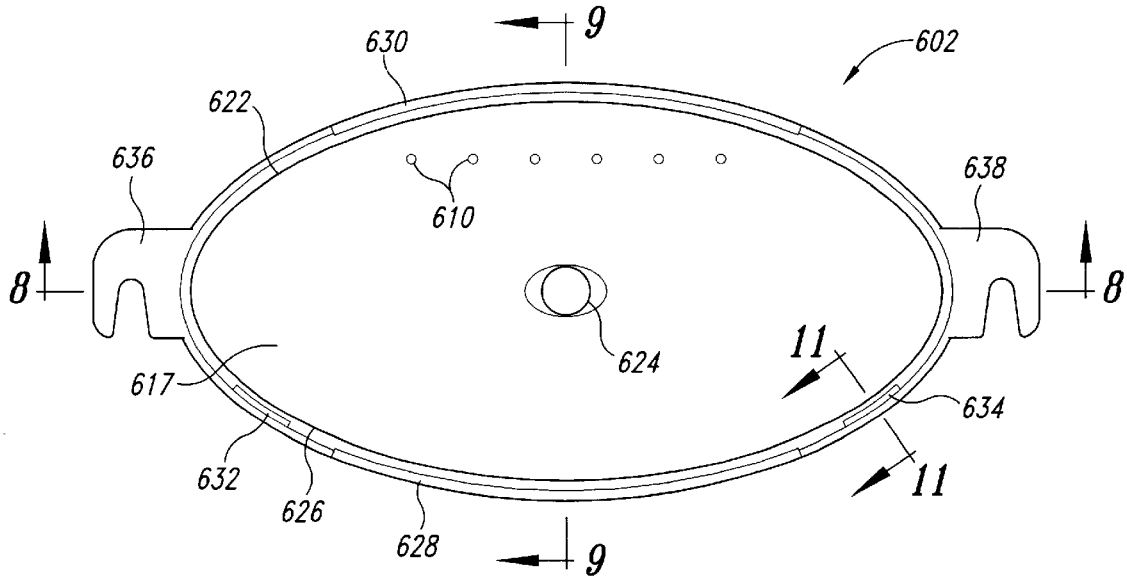
FIG. 7 is a front view of the ellipsoid-shaped housing of FIG. 6.
Figure 8:
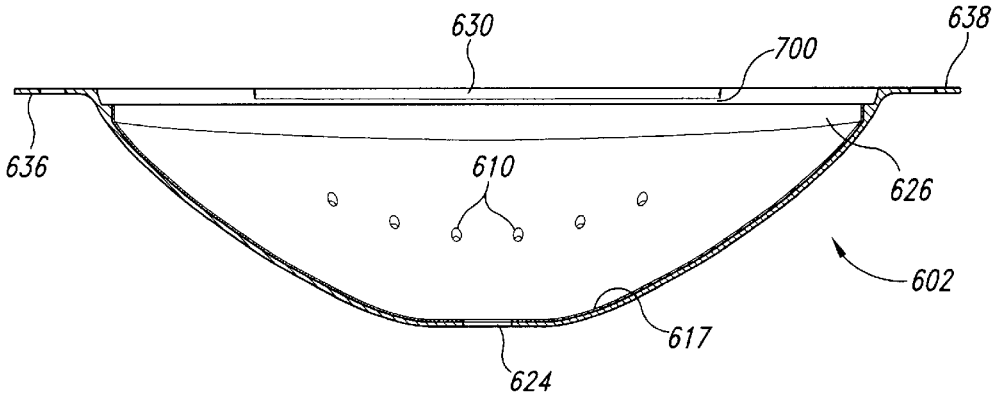
FIG. 8 is a bottom view of the ellipsoid-shaped housing of FIG. 6.
Figure 9:
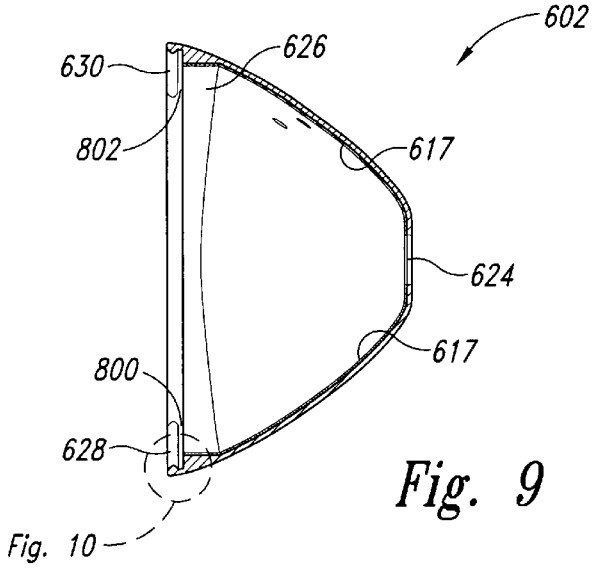
FIG. 9 is a side view of the ellipsoid-shaped housing of FIG. 6.

FIGS. 7–9 are various views that further illustrate the structure of the housing 602 of FIG. 6. FIG. 7 is a front view of the housing 602 that better illustrates the top outer lens retaining projection 630 and formation of the apertures of the pry slots 632, 634 in the inner lens retaining projection 626. In the embodiment of FIG. 7, the outer lens retaining projections 628, 630 extend along top and bottom portion of the aperture 622, but the number and location of these projections may vary, as will be appreciated by those skilled in the art. The housing 602 made from a high-heat plastic or other suitable material, and may be formed through injection molding or other suitable processes.

FIG. 8 is a bottom view and FIG. 9 is a side view of the ellipsoid-shaped housing 600 which better illustrate the depth of the housing 600 and structure of the lens retaining projections 626 and 630. In FIG. 8, the elliptical lens 604 (not shown) fits in the space 700 between the outer lens retaining projection 630 and the inner lens retaining projection 626. In FIG. 9, the bottom of the elliptical lens 604 fits in the space 800 between the outer lens retaining projection 628 and the inner lens retaining projection 626, and the top of the elliptical lens 604 fits in the space 802 between the outer lens retaining projection 630 and the inner lens retaining projection 626.

Figure 10:
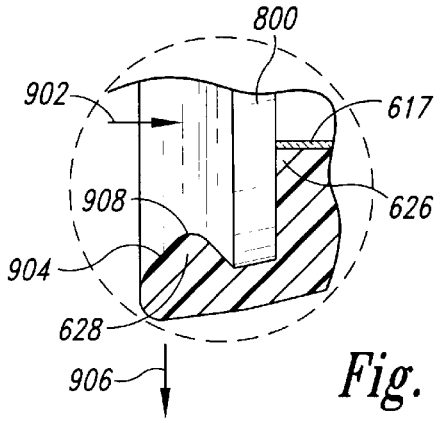
FIG. 10 is an exploded view illustrating the lens-retaining projection of FIG. 9.

FIG. 10 is an exploded view better illustrating the position of the elliptical lens 604 in place between the inner lens retaining projection 626 and the outer lens retaining projection 628. To mount the lens 604 in position between the projections 626 and 628, the lens is pushed inward as indicated by an arrow 902. As the lens 604 is pushed inward, the lens makes contact with a front angled surface 904 of the outer lens retaining projection 628. The relatively rigid lens 604 applies an outward force indicated by an arrow 906 as the lens is pushed inward along the direction 902. The housing 602 outwardly flexes in the direction 906 in response to the outward force from the lens 604 until the lens is pushed beyond a peak 908 of the outer lens retaining projection 628. Once the lens 604 is pushed beyond the peak 908, the housing 602 begins to inwardly flex so that the projection 606 moves in front of the lens 604 to thereby secure the lens in position a shown in FIG. 10.

Figure 11:
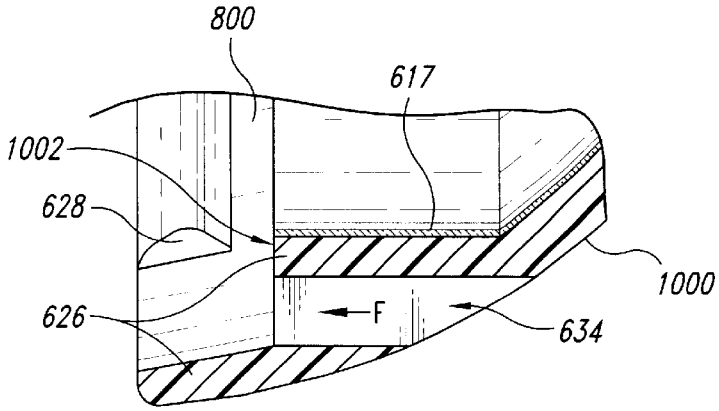
FIG. 11 is an exploded side view of the pry slot 612 of FIG. 6.

FIG. 11 is an exploded side view of the pry slot 634 of FIG. 6. The pry slot 634 extends from and outer surface 1000 of the housing 602 to the front surface 1002 of the inner lens retaining projection 626. The elliptical lens 604 is shown secured in place against the front edge of the inner lens retaining projection 626. To remove the lens 604, a screwdriver or other suitable object is inserted into the pry slot 634 to apply a force F to the lens 604. In response to the force F, the lens 604 moves outwardly towards the front of the housing 602 and once the lens 900 is beyond the peak 908 of the outer lens retaining projection 628 (see FIG. 10) the lens 604 may be removed from housing.

One skilled in the art will appreciate various changes may be made to the lighted sign displays 2 and 600. For example, the reflective coatings 21 and 617 may be omitted and the respective lenses 6 and 604 may be formed of a suitable optically diffusing material such as white plastic, or the lenses may be coated on one side with optical diffusing material, such as white ink, to diffuse optical energy incident on the lenses and eliminate the need for the reflective coatings. Such optically diffusing material may be applied as a plurality of layers, and may be applied to the same side of the lens 6, 604 as the message 8, 614, respectively, or may be applied to the opposite side of the lens.

It is to be understood that even though various embodiments and advantages of the present invention have been set forth in the foregoing description, the above disclosure is illustrative only, and changes may be made in detail, and yet remain within the broad principles of the invention. Therefore, the present invention is to be limited only by the appended claims.

What is claimed is:

1. A lighted sign display assembly with an illuminated translucent lens and a lens removal aperture, comprising:

a housing having an interior surface and an exterior surface, the housing including, a translucent lens having areas that are formed to convey visual information and being formed to diffuse light incident on the lens;

a lens aperture formed at a base end of the housing, the lens aperture being adapted to secure the lens to the housing within the lens aperture;

a lens removal aperture formed near the base end of the housing, the lens removal aperture being adapted to receive an object that applies a force to the lens to thereby assist in removing the lens from the aperture;

at least one mounting projection formed near the base end of the housing, the mounting projection being adapted to receive a mounting device to secure the display assembly to a desired object;

an illumination aperture formed at an end of the housing opposite the lens aperture, the illumination aperture being adapted to secure an illumination assembly to the housing within the illumination aperture; and an illumination assembly secured in the illumination aperture, the illumination assembly being adapted to receive electrical energy and generate optical energy from the electrical energy.

2. The lighted sign display assembly of claim 1 wherein the housing is formed from high-heat plastic.

3. The lighted sign display assembly of claim 1 wherein the housing comprises an ellipsoid-shaped housing.

4. The lighted sign display assembly of claim 1 wherein the housing includes at least one inner mounting projection, each inner mounting projection being formed on the interior surface of the housing near the lens aperture, and wherein the housing includes at least one outer mounting projection, each outer mounting projection being formed on the interior surface of the housing nearer the lens aperture than each inner mounting projection, the lens being secured in place between each inner and outer mounting projection.

5. The lighted sign display assembly of claim 1 wherein each mounting projection is formed in a hook shape adapted to slidably receive a suction cup which then secures the display assembly to a window or other smooth surface such that the display assembly can be removed from the suction cup without moving the suction cup.

6. The lighted sign display assembly of claim 1 wherein the lens removal aperture comprises a rectangular slit.

7. The lighted sign display assembly of claim 1 wherein the lens comprises areas formed on a first side of the lens to convey visual information, and at least one optically diffusing layer is applied to the first side of the lens to cover at least a portion of the first side and diffuse light from the illumination assembly.

8. The lighted sign display assembly of claim 1 wherein the mounting projection is formed near the illumination aperture.

9. An ellipsoidal lighted sign display assembly, comprising:

an ellipsoid-shaped housing having an interior surface and an exterior surface, and the housing including, an elliptical lens aperture formed at a base end of the ellipsoid-shaped housing, the lens aperture being adapted to secure an elliptical lens to the housing within the aperture, the elliptical lens having areas that are formed to convey visual information;

at least one mounting projection formed near the base end of the housing, the mounting projection being adapted to receive a mounting device to secure the display assembly to a desired object;

an illumination aperture at an apex end of the ellipsoid-shaped housing, the illumination aperture being adapted to secure an illumination assembly to the housing within the illumination aperture; and an illumination assembly secured in the illumination aperture, the illumination assembly being adapted to receive electrical energy and generate optical energy from the electrical energy.

10. The lighted sign display assembly of claim 9 wherein the housing is formed from high-heat plastic.

11. The lighted sign display assembly of claim 9 further comprising a reflective coating covering at least some of the interior surface, the coating comprising an optically reflective paint.

12. The lighted sign display assembly of claim 9 wherein the housing includes at least one inner mounting projection, each inner mounting projection being formed on the interior surface of the housing near the elliptical lens aperture, and wherein the housing includes at least one outer mounting projection, each outer mounting projection being formed on the interior surface of the housing nearer the elliptical lens aperture than each inner mounting projection, the lens being secured in place between each inner and outer mounting projection.

13. The lighted sign display assembly of claim 9 wherein each mounting projection is formed in a hook shape adapted to slidably receive a suction cup which then secures the display assembly to a window or other smooth surface such that the display assembly can be removed from the suction cup without moving the suction cup.

14. A lighted sign display assembly for a vehicle window, removably mounted on suction cups, comprising:

a housing having an interior surface and an exterior surface, and the housing including, a lens aperture formed at a base end of the housing;

at least one inner mounting projection and at least one outer mounting projection, each inner mounting projection being formed on the interior surface of the housing near the lens aperture, and each outer mounting projection being formed on the interior surface of the housing nearer the lens aperture than each inner mounting projection, the lens being secured in place between the inner and outer mounting projections;

at least one mounting projection formed near the base end of the housing, the mounting projection being formed in a hook shape to slidably receive a suction cup to secure the display assembly to a desired object such that the display can be removed without moving the suction cup;

an illumination aperture at an apex end of the housing, the illumination aperture being adapted to secure an illumination assembly to the housing within the illumination aperture;

at least one temperature aperture, each temperature aperture being formed to allow heat generated by the illumination assembly to be transferred from the interior surface side of the housing to the exterior surface side; and a reflective coating covering at least some of the interior surface of the housing, the reflective coating reflecting light generated by the illuminating assembly towards the lens;

a translucent lens secured between the inner and outer mounting projections to position the lens in the lens aperture, the lens having areas formed to convey visual information;

an illumination assembly including electrical terminals, the illumination assembly generating optical energy in response to electrical energy applied to the electrical terminals; and a power adapter coupled to the electrical terminals of the illumination assembly, the power adapter being adapted to receive electrical energy and apply this electrical energy to the electrical terminals of the illumination assembly.

15. The lighted sign display assembly of claim 14 wherein the temperature apertures are formed in a portion of the housing that is positioned upward during use of the display assembly.

16. The lighted sign display assembly of claim 14 wherein the housing is formed from high-heat plastic.

17. The lighted sign display assembly of claim 14 wherein the reflective coating comprises an optically reflective paint.

18. The lighted sign display assembly of claim 14 wherein the power adapter comprises a power adapter including power clips for coupling the power adapter to running lights in a vehicle to receive electrical power from the running lights.

19. A suction cup mounted lighted sign display assembly adapted for electrical coupling to running lights of an automobile, comprising:

a housing having an interior surface and an exterior surface, the housing including, a lens aperture formed at a base end of the housing;

a translucent lens mounted in the lens aperture;

at least two display mounting projections;

a suction cup coupled to each display mounting projection;

an illumination assembly at an end of the housing opposite the lens aperture; and the illumination assembly including electrical terminals, the illumination assembly generating optical energy in response to electrical energy applied to the electrical terminals;

the power adapter including power clips for coupling the power adapter to running lights in a vehicle to receive electrical power from the running lights.

20. The lighted sign display assembly of claim 1 wherein the housing is formed from a high-heat plastic.

21. The lighted sign display assembly of claim 1 wherein the housing comprises an ellipsoid-shaped housing.

* * * * *

UNITED STATES PATENT AND TRADEMARK OFFICE

CERTIFICATE OF CORRECTION

PATENT NO. : 6,338,563 B1
DATED : January 15, 2002
INVENTOR(S) : Jeff Norman

It is certified that error appears in the above-identified patent and that said Letters Patent is hereby corrected as shown below:

Column 8,
Lines 48 and 50, Claims 20 and 21 are dependant upon claim 19 not claim 1. Therefore, change "1" to -- 19 -- after "claim" and before "wherein".

Signed and Sealed this

Fourteenth Day of May, 2002

*Attest:*

*Attesting Officer*

JAMES E. ROGAN
*Director of the United States Patent and Trademark Office*